United States Patent [19]

Rice

[11] 4,124,035

[45] Nov. 7, 1978

[54] SELF PRIMING SIPHON

[76] Inventor: John H. Rice, 104 Palm Ct., Santa Maria, Calif. 93454

[21] Appl. No.: 817,683

[22] Filed: Jul. 21, 1977

[51] Int. Cl.[2] ..... F04F 10/02

[52] U.S. Cl. ..... 137/128; 137/126

[58] Field of Search ..... 137/126, 128

[56] References Cited

FOREIGN PATENT DOCUMENTS 369,760 2/1923 Fed. Rep. of Germany ..... 137/128

427 of 1895 United Kingdom ..... 137/126

*Primary Examiner*—Gerald A. Michalsky

*Attorney, Agent, or Firm*—Fidelman, Wolffe & Waldron

[57] ABSTRACT

A self priming siphon device having a pilot siphon tube which discharges into a priming chamber thereby creating a partial vacuum within the priming chamber sufficient to cause flow through additional auxiliary siphon tubes. The partial vacuum is produced by liquid flowing from the priming chamber through priming tubes to a discharge point.

9 Claims, 3 Drawing Figures

SELF PRIMING SIPHON

BACKGROUND OF THE INVENTION

1. Field of the Invention

This invention relates generally to intermittantly operating, self priming siphons. More particularly, this invention provides an apparatus for intermittantly emptying a liquid filler vessel by siphon action at a rate faster than the vessel is filled.

2. Description of the Prior Art

Need often arises for a device to periodically discharge accumulated liquid from a holding vessel. This is often accomplished by means of mechanically or pneumatically operated valves controlled by timing devices, level switches and the like. Such devices have the disadvantages of requiring a power source such as electricity and necessarily contain a multiplicity of moving parts. Furthermore, services such as electricity are often not conveniently available at the site of use.

It has also been proposed to use self priming siphons for similar purposes. Self priming siphons known in the prior art generally rely upon complicated structure, such as a pilot siphon operating in conjunction with a venturi nozzle to accomplish priming.

SUMMARY OF THE INVENTION

A self priming siphon is provided which operates automatically to empty a liquid containing vessel no matter how slowly liquid is added to the vessel. A pilot siphon tube of particular diameter primes auxiliary siphon tubes by co-action with a priming chamber having downwardly disposed priming tubes adapted to create a partial vacuum within the primary chamber.

Hence, it is an object of this invention to provide an automatic siphon device.

It is another object of this invention to provide a self priming siphon to rapidly empty a slowly filling vessel.

It is yet another object of this invention to provide a simplified construction for self priming siphons.

DISCUSSION OF THE INVENTION

This invention comprises a self priming siphon useful for automatically emptying or discharging a predetermined amount of liquid from a vessel or container. An important characteristic of the device is that operation is completely independent of the flow rate of liquid into the vessel. Thus, no matter how slowly liquid is introduced into the vessel, once a certain critical level is reached the siphon operates surely and automatically. The structure and operation of the siphon device will be described in relation to the accompanying drawing.

Figure 1:
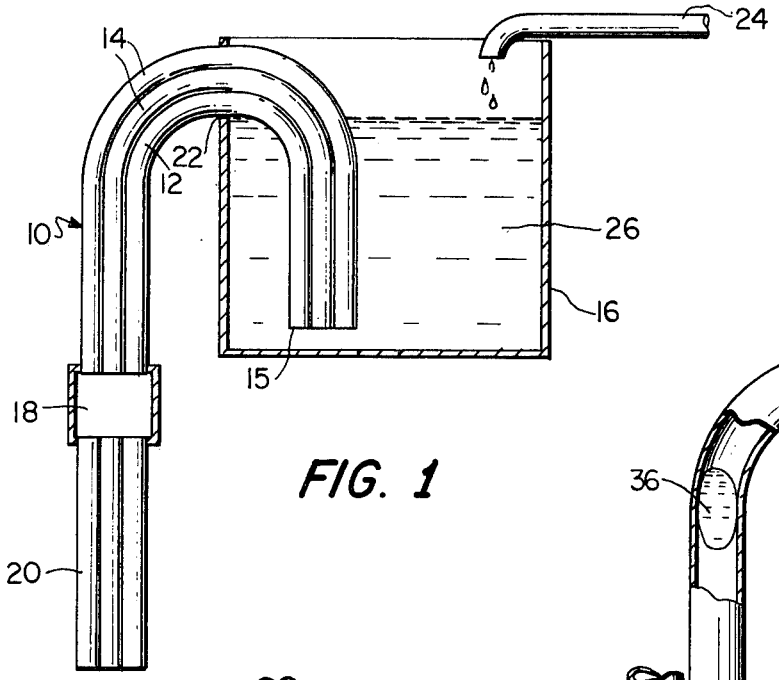
FIG. 1 is a schematic illustration of one embodiment of the invention and its method of use.

Referring now to FIG. 1, the self priming siphon of this invention is designated generally at 10. Siphon 10 includes a pilot siphon tube 12 and auxiliary siphon tube 14 which communicate between a lower level, 15 of a liquid holding vessel 16 and a priming chamber 18. Priming chamber 18 comprises an open chamber, preferably of cylindrical shape, having a flat bottom manifold opening into a plurality of priming tubes 20, the lower ends of which are open to the atmosphere. Liquid is supplied to vessel 16 via conduit means 24.

Apex 22 of pilot siphon tube 12 is disposed at a lower elevation relative to the level of liquid 26 in vessel 16 than are the apices of auxiliary siphon tubes 14. Thus, as the level of liquid 26 in vessel 16 rises, flow will begin through pilot siphon 12.

Figure 2:
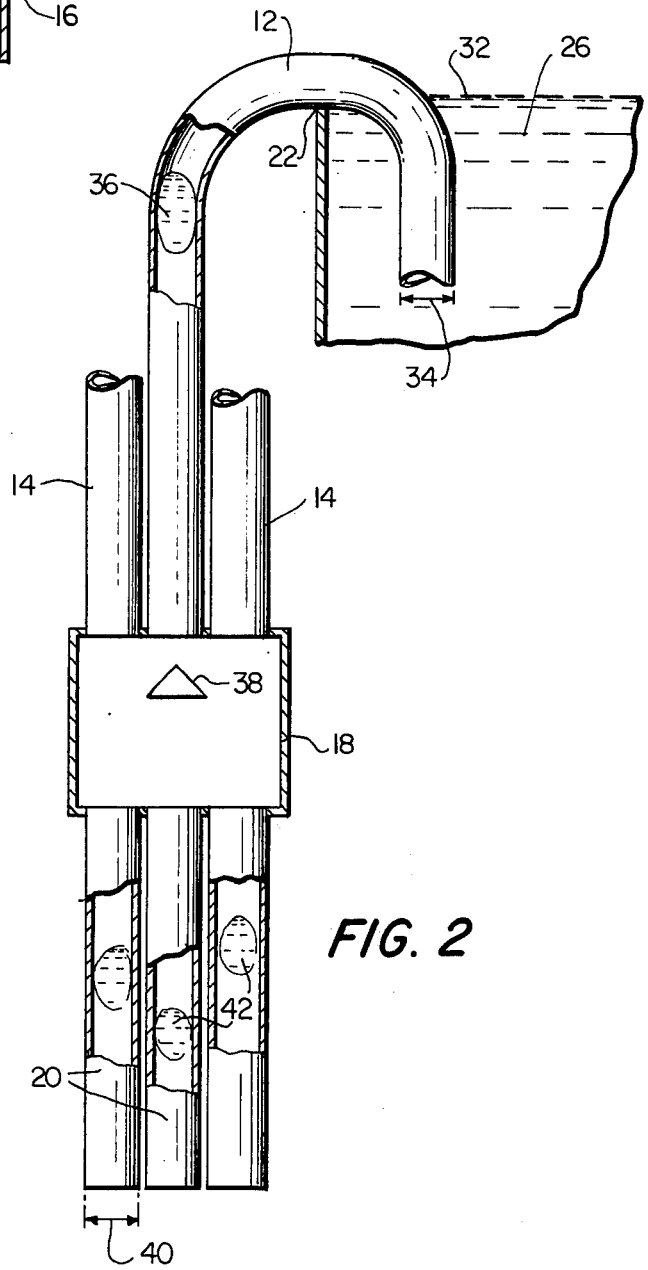
FIG. 2 is an enlarged detailed view in partial section illustrating the priming action of this invention.

Operation of siphon device 10 is illustrated in more detail in FIG. 2. As the level 32 of liquid 26 rises to an elevation slightly above apex 22 of pilot siphon tube 12, flow will begin through tube 12. Inside diameter 34 of tube 12 must be equal to or smaller than a certain critical diameter which is dependent upon the composition of liquid 26 and the material of which tube 12 is made.

This critical diameter is defined as the maximum diameter which results in liquid 26 forming, during initial liquid passage, droplets 26 which bridge the interior of tube 12 to form a moving plug. As may be appreciated, the critical diameter is dependent upon the wettability characteristics of the tube material relative to the liquid. In the case wherein tube 12 is constructed of plastic and liquid 26 is water, the critical diameter is on the order of 3/16 to ¼ inch.

If the diameter of tube 12 were to exceed this critical diameter, the siphoning effect would be delayed until liquid level 32 rose sufficiently to cause full bore flow through tube 12. Until that time, tube 12 would merely act as an overflow weir. If the inflow of liquid to vessel 16 were at a rate less than full bore flow of tube 12, then siphoning would not begin at all. Thus, the criticality of the pilot siphon tube diameter to the proper functioning of this invention can be readily appreciated.

As the first droplet or liquid plug 36 progresses down tube 12, there is caused a sufficient suction to establish full flow down the tube. Tube 12 discharges into priming chamber 18, preferably at the center thereof. Chamber 18 is essentially an empty surge chamber which may have disposed at a point below the termination of tube 12 a flow disperser 38 to direct the liquid flow from tube 12 into a uniform fashion across the bottom of chamber 18.

Downwardly extending priming tube 20, shown in partial section, communicate between the interior of chamber 18 and the atmosphere. Priming tubes 20 must also have an inside diameter equal to or smaller than the critical diameter as was previously discussed in relation to pilot siphon tube 12. Preferably siphon tube 12 and priming tubes 20 have the same internal diameter.

As liquid is dispersed over the bottom of chamber 18, it enters tubes 20 to form droplets 42 which bridge the interior of each tube as downwardly moving plugs. As soon as a plug has been formed in each of priming tubes 20, there is created a partial vacuum within chamber 18 by the downward movement of droplet plugs 42. The partial vacuum thus created is sufficient to prime auxiliary siphon tubes 14 and establish maximum flow of device 10. Flow continues until the liquid level in vessel 16 drops below level 15 of the siphon tubes. Thereafter, vessel 16 refills and the cycle is repeated.

Priming siphon tube 12 delivers sufficient flow to prime six or more auxiliary siphon tubes 14. The number of priming tubes is not critical but should be sufficient to handle the combined maximum flows of priming siphon 12 and auxiliary siphons 14.

Figure 3:
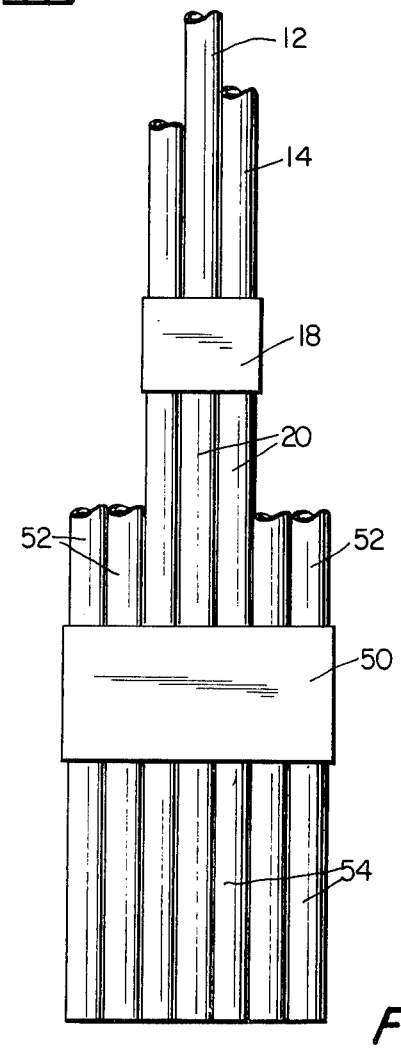
FIG. 3 is an illustration of an alternative embodiment of this invention having enhanced flow capacity.

Capacity of siphon device 10 may be increased in the manner shown schematically in FIG. 3. In this embodiment, priming siphon tube 12, auxiliary siphon tubes 14, priming chamber 18 and priming tubes 20 are arranged as described in relation to FIGS. 1 and 2. Rather than discharging to the atmosphere as previously described, priming tubes 20 discharge into a secondary priming chamber 50. Chamber 50 is similar in construction and arrangement to chamber 18 having a second set of auxiliary siphon tubes 52 communicating between the interior of the chamber and liquid 26. A second set of priming tubes 54 communicate between the interior of chamber 50 and the atmosphere.

The liquid flow established in auxiliary siphon tube 14 and through priming chamber 18, is dispersed over the bottom of secondary priming chamber 50. Liquid enters tubes 54 bridging the interior of each tube to create a partial vacuum within chamber 50. Flow is then established through the second set of auxiliary siphon tubes 52 by action of the reduced pressure or partial vacuum within chamber 50.

The siphon device may be constructed from commercially available metal or plastic tubing. In some applications, it is advantageous to utilize flexible tubing as that allows more convenient installation. It is important in any installation that the priming chamber be oriented with its bottom in a horizontal attitude so as to insure proper distribution of liquid from the pilot siphon tube into the priming tubes.

This invention will find use in any application wherein it is necessary or desirable to intermittantly and automatically discharge the contents of a liquid holding vessel. In particular, this invention will be useful in those applications in which liquid is added to the vessel at very slow rates as operation of the device is unaffected by rate of liquid input to the holding vessel.

One specific application resides in the use of this device to more fully utilize a source of water. Many springs, for example, have been developed to feed into a storage tank or trough to supply drinking water for humans and animals. The spring feeds the storage tank at a relatively constant rate and maintains the tank at a full condition most of the time. Excess water is usually wasted. By equipping the storage tank with the automatic siphon of this invention, the tank could be periodically emptied to use the excess water for irrigation. The larger though intermittant flow thus obtained can operate a sprinkler or other distribution means which the smaller but steady spring flow cannot.

Other modifications and uses of this device will be obvious to those having skill in the art.

What is claimed:

1. A self priming siphon comprising a pilot siphon tube and a plurality of auxiliary siphon tubes communicating in an arcuate path between a lower level of a liquid holding vessel and the top of a priming chamber and a plurality of downwardly extending priming tubes communicating between the bottom of the priming chamber and the atmosphere, the apex of said pilot siphon tube being disposed at a lower elevation relative to the liquid level in said vessel than the apices of said auxiliary siphon tubes and the internal diameter of said pilot siphon tube and said priming tubes being equal to or less than the maximum diameter which results in the liquid forming droplets which bridge and plug the interior of said tubes.

2. The device of claim 1 wherein a flow disperser is disposed within the priming chamber at a point below the termination of said pilot siphon tube.

3. The device of claim 1 wherein the priming chamber is of cylindrical shape.

4. The device of claim 3 wherein said pilot siphon tube discharges into the priming chamber at the center thereof.

5. The device of claim 1 wherein said pilot and auxiliary siphon tubes are flexible.

6. The device of claim 5 wherein said tubes are constructed of plastic having an internal diameter of less than about ¼ inch and wherein the liquid in said vessel is water.

7. The device of claim 1 wherein said priming tubes discharge into a secondary priming chamber, said secondary chamber having a second set of downwardly extending priming tubes communicating between the bottom of said chamber and the atmosphere and having a second set of auxiliary siphon tubes communicating between the top of said secondary chamber and the liquid in said vessel.

8. The device of claim 7 wherein said secondary priming chamber is of cylindrical shape.

9. The device of claim 1 wherein said pilot siphon tube and said priming tubes have the same internal diameter.

* * * * *